US007033228B1

(12) United States Patent
Liu

(10) Patent No.: US 7,033,228 B1
(45) Date of Patent: Apr. 25, 2006

(54) ELECTRICAL CONNECTOR WITH ADDITIONAL BOARDS

(75) Inventor: Lu-Ta Liu, Taipei (TW)

(73) Assignee: Lankom Electronics Co., Ltd., (TW)

( * ) Notice: Subject to any disclaimer, the term of this patent is extended or adjusted under 35 U.S.C. 154(b) by 0 days.

(21) Appl. No.: 11/121,248

(22) Filed: May 3, 2005

(51) Int. Cl.
*H01R 24/00* (2006.01)

(52) U.S. Cl. ..... 439/676; 439/680

(58) Field of Classification Search ..... 439/884, 439/676, 675, 660, 677, 680–681
See application file for complete search history.

(56) References Cited

U.S. PATENT DOCUMENTS 5,096,441 A * 3/1992 Jaag ..... 439/676
6,010,367 A * 1/2000 Wu ..... 439/620
6,086,429 A * 7/2000 Wu ..... 439/676
6,257,935 B1 * 7/2001 Zhang et al. ..... 439/680
6,375,505 B1 * 4/2002 Lin ..... 439/607
6,402,562 B1 * 6/2002 Chang et al. ..... 439/676
6,773,298 B1 * 8/2004 Gutierrez et al. ..... 439/490

* cited by examiner

*Primary Examiner*—Michael C. Zarroli
(74) *Attorney, Agent, or Firm*—Jackson Walker, LLP

(57) ABSTRACT

An electrical connector with additional boards has a body, a case and two additional boards. The body has two sides, a key protrusion and a key recess. The key protrusion and the key recess are formed respectively on the two sides and correspond to each other. The case is mounted on the body and has two sides, a key protrusion and a key recess. The key protrusion and the key recess are formed on the two sides of the case and correspond to each other. The additional boards are mounted respectively on the sides of the body and the case and each additional board has a key recess and a key protrusion formed on one of the sides of each additional board and respectively corresponding to and engaging the key protrusions and the key recess of the body and the case.

2 Claims, 3 Drawing Sheets

ELECTRICAL CONNECTOR WITH ADDITIONAL BOARDS

BACKGROUND OF THE INVENTION

1. Field of the Invention

The present invention relates to electrical connector, especially to an electrical connector with additional boards.

2. Description of the Prior Arts

Electrical connectors are mounted in sockets in electrical appliances such as telephones to transform signals that are transported by the electrical wires. However, the widths of the sockets in the electrical appliances are not the same. To fit the different sockets in the electrical appliances, the different widths of the conventional electrical connectors have to be manufactured. Manufacturing different widths of the conventional electrical connectors is expensive and time-consuming.

To overcome the shortcomings, the present invention provides an electrical connector with additional boards to mitigate or obviate the aforementioned problems.

SUMMARY OF THE INVENTION

The main objective of the present invention is to provide an electrical connector with additional boards. The electrical connector with additional boards has a body, a case and two additional boards. The body has two sides, a key protrusion and a key recess. The key protrusion and the key recess are formed respectively on the two sides and correspond to each other. The case is mounted on the body and has two sides, a key protrusion and a key recess. The key protrusion and the key recess are formed on the two sides of the case and correspond to each other. The additional boards are mounted respectively on the sides of the body and the case and each additional board has a key recess and a key protrusion. The key recess is formed on one of the sides of each additional board and corresponds to and engages the key protrusions on the body and the case. The key protrusion is formed on the side of each additional board and corresponds to and engages the key recess in the body and the case.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
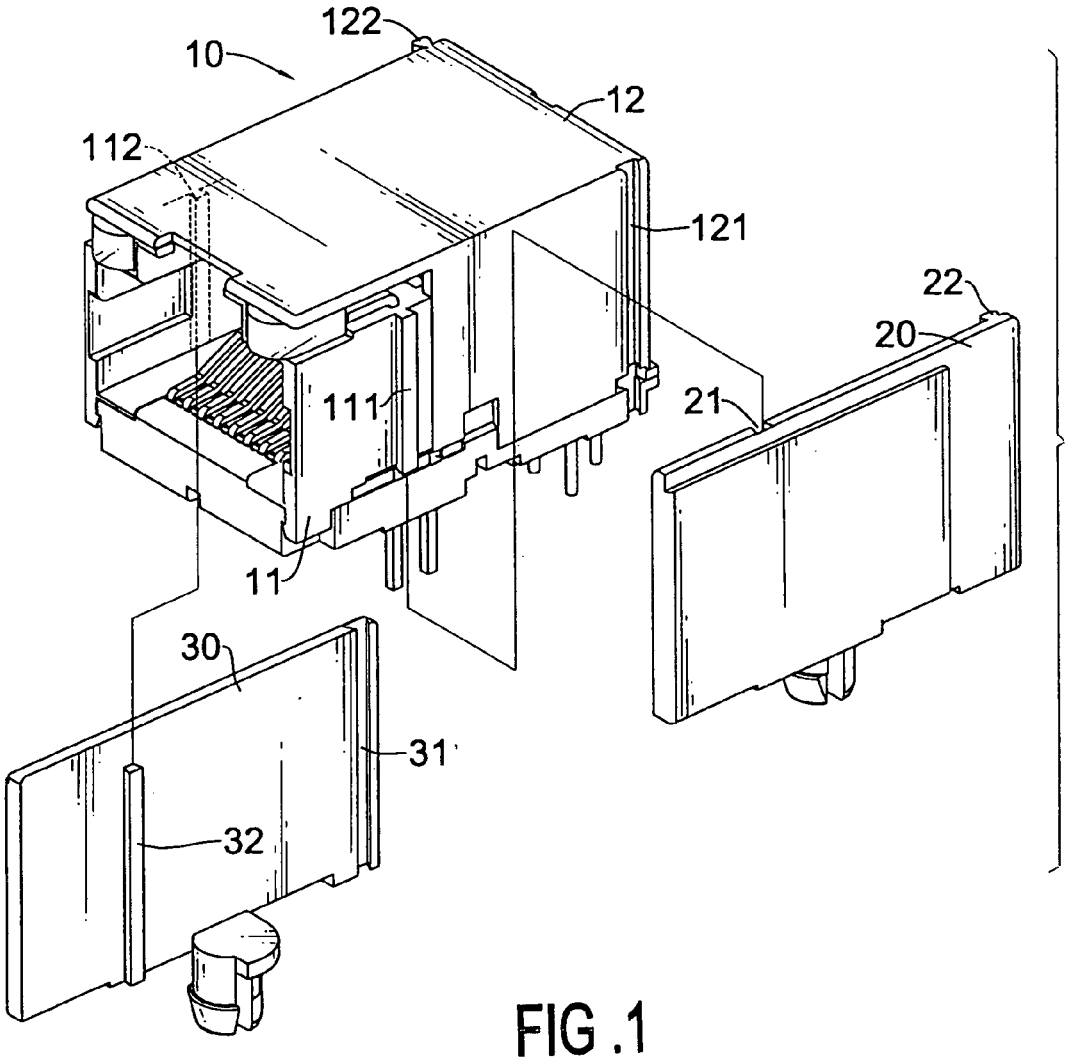
FIG. 1 is an exploded perspective view of an electrical connector in accordance with the present invention with two additional boards.

With reference to FIG. 1, an electrical connector (10) with additional boards in accordance with the present invention comprises a body (11), a case and two additional boards (20, 30).

The body (11) has a front end, a rear end, two sides, a socket, multiple contacts, a key protrusion (111) and a key recess (112). In the preferred embodiment, the two sides are a right side and a left side. The socket is formed in the front end. The contacts are mounted in the socket. The key protrusion (111) and the key recess (112) are formed respectively on the sides and correspond to each other. In the preferred embodiment, the key protrusion (111) is formed on the right side and the key recess (112) is formed in the left side.

The case (12) is mounted on the rear end of the body (11) and has two sides, a key recess (121) and a key protrusion (122). In the preferred embodiment, the two sides are a right side and a left side. The key recess (121) and the key protrusion (122) are formed respectively on the sides of the case (12) and correspond to each other. In the preferred embodiment, the key recess (121) is formed in the right side of the case (12) and the key protrusion (122) is formed on the left side of the case (12).

Figure 2:
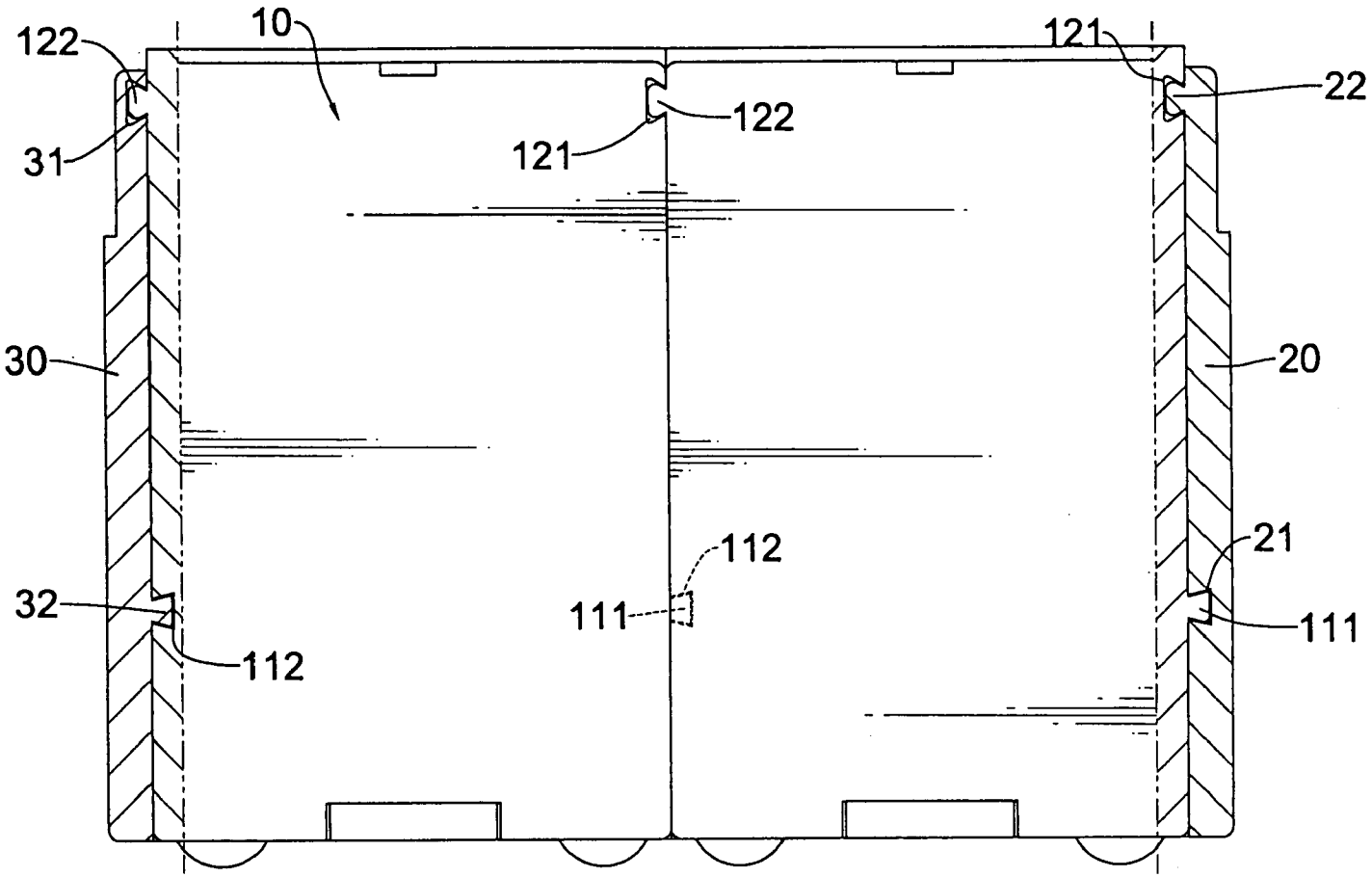
FIG. 2 is a top view in partial section of the electrical connector in FIG. 1 with two additional boards.

With further reference to FIG. 2, the two additional boards (20, 30) are mounted respectively on the sides of the body (11) and the case (12). Each additional board (20, 30) has two sides, a key recess (21, 31) and a key protrusion (22, 32). The key recess (21, 31) is formed on one of the sides of each additional board (20, 30) and corresponds to and engages the key protrusions (111, 122) on the body (11) and the case (12). The key protrusion (22, 32) is formed on the side of each additional board (20, 30) and corresponds to and engages the key recess (112, 121) in the body (11) and the case (12).

In the preferred embodiment, the additional boards (20, 30) are a right additional board (20) and a left additional board (30). The right additional board (20) is mounted on the right side of the body (11) and the case (12) and has a left side, a front end and a rear end. The key recess (21) is formed in the left side of the right additional board (20) near the front end and corresponds to and engages the key protrusion (111) on the body (11). The key protrusion (22) is formed on the left side of the right additional board (20) near the rear end and corresponds to and engages the key recess (121) in the case (12). The left additional board (30) is mounted on the left side of the body (11) and the case (12) and has a right side, a rear end and a front end. The key recess (31) is formed in the right side of the left additional board (30) near the rear end and corresponds to and engages the key protrusion (122) on the case (12). The key protrusion (32) is formed on the right side of the left additional board (30) near the front end and corresponds to and engages the key recess (112) in the body (11).

The engagement between the body (11) and the case (12) with the additional boards (20, 30) changes the width of the electrical connectors (10) to fit different sizes of the sockets in the electrical appliances.

Figure 3:
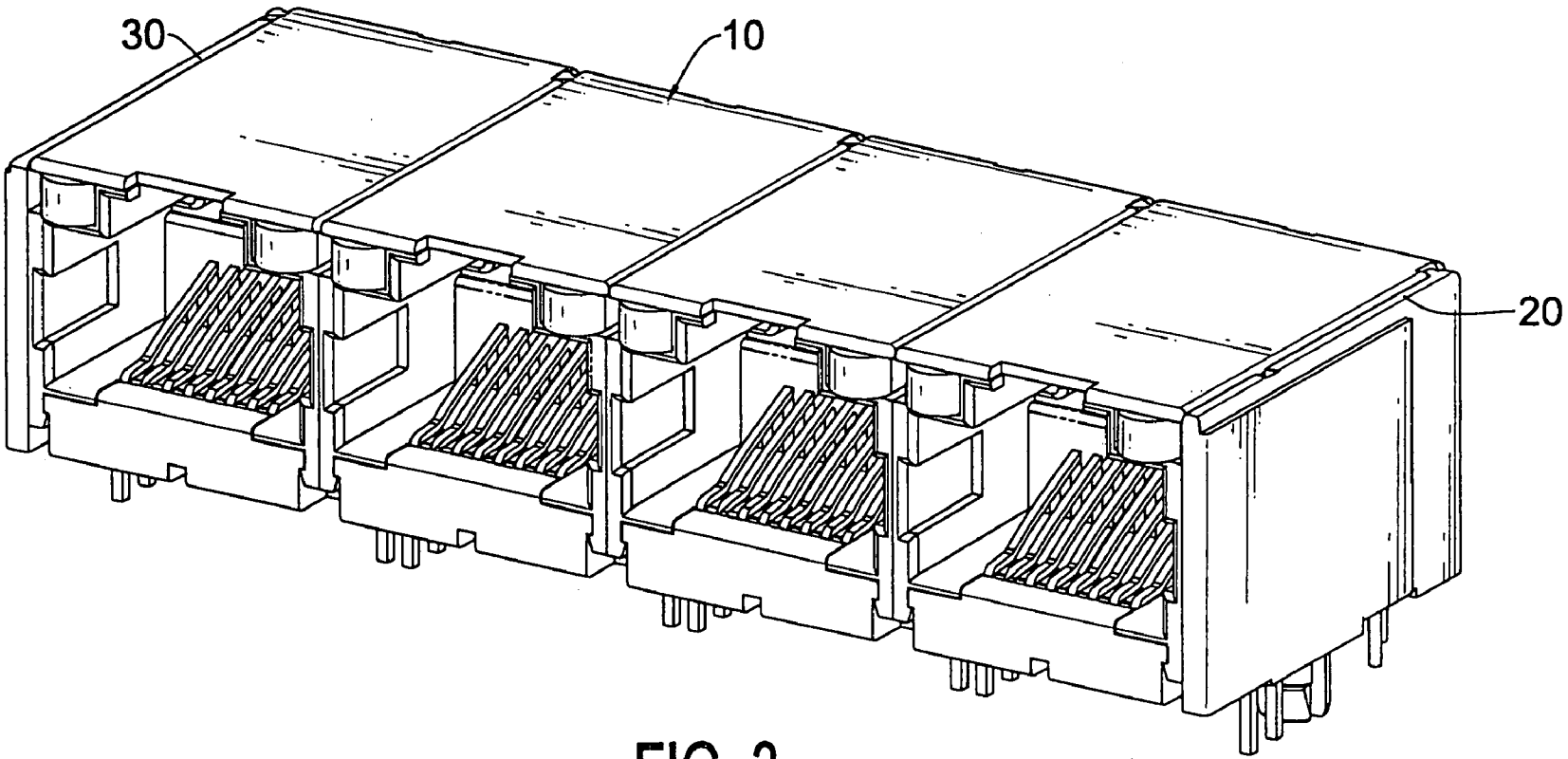
FIG. 3 is a perspective view of multiple electrical connectors of FIG. 1 with two additional boards.

With further reference to FIG. 3, multiple electrical connectors (10) connect to one another with the key protrusions (111, 122) engaging the key recess (112, 121) when multiple connecting electrical connectors (10) are needed.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector with additional boards comprising a body having a front end;

a rear end;

two sides;

a socket formed in the front end;

multiple contacts mounted in the socket; and a key protrusion and a key recess formed respectively on the sides and corresponding to each other;

a case mounted on the rear end of the body and having two sides; and a key recess and a key protrusion formed respectively on the sides of the case and corresponding to each other; and two additional boards mounted respectively on the sides of the body and the case, each additional board having two sides;

a key recess formed on one of the sides of each additional board and corresponding to and engaging the key protrusions on the body and the case; and a key protrusion formed on the side of each additional board and corresponding to and engaging the key recess in the body and the case.

2. The electrical connector with additional boards as claimed in claim 1, wherein the two sides of the body is a right side and a left side;

the key protrusion on the body is formed on the right side of the body;

the key recess in the body is formed in the left side of the body;

the two sides of the case is a right side and a left side;

the key recess in the case is formed in the right side of the case;

the key protrusion on the case is formed on the left side of the case;

the additional boards are a right additional board mounted on the right side of the body and the case and having a left side, a front end and a rear end; and a left additional board mounted on the left side of the body and the case and having a right side, a front end and a rear end;

the key recess in the right additional board is formed in the left side of the right additional board near the front end and corresponds to and engages the key protrusion on the body;

the key protrusion on the right additional board is formed on the left side of the right additional board near the rear end and corresponds to and engages the key recess in the case;

the key recess in the left additional board is formed in the right side of the left additional board near the rear end and corresponds to and engages the key protrusion on the case; and the key protrusion on the left additional board is formed on the right side of the left additional board near the front end and corresponds to and engages the key recess in the body.

* * * * *